US011849906B2

(12) United States Patent
Bradley

(10) Patent No.: US 11,849,906 B2
(45) Date of Patent: Dec. 26, 2023

(54) VACUUM CLEANER

(71) Applicant: Techtronic Floor Care Technology Limited, Tortola (VG)

(72) Inventor: Jerald Bradley, Charlotte, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 146 days.

(21) Appl. No.: 17/583,966

(22) Filed: Jan. 25, 2022

(65) Prior Publication Data

US 2022/0142424 A1 May 12, 2022

Related U.S. Application Data

(63) Continuation of application No. 16/514,466, filed on Jul. 17, 2019, now Pat. No. 11,229,341.

(60) Provisional application No. 62/700,493, filed on Jul. 19, 2018.

(51) Int. Cl.

| | |
|---|---|
| ***A47L 9/16*** | (2006.01) |
| ***A47L 9/14*** | (2006.01) |
| ***A47L 5/24*** | (2006.01) |

(52) U.S. Cl.

CPC ..... *A47L 9/1691* (2013.01); *A47L 9/1409* (2013.01); *A47L 9/1683* (2013.01); *A47L 5/24* (2013.01)

(58) Field of Classification Search

CPC .... A47L 9/1691; A47L 9/2857; A47L 9/1658; A47L 9/2884; A47L 5/24

USPC ..... 15/344, 352

See application file for complete search history.

(56) References Cited

U.S. PATENT DOCUMENTS

| | | | | |
|---|---|---|---|---|
| 6,836,931 | B2 | 1/2005 | Bone | |
| 7,105,035 | B2 | 9/2006 | Oh et al. | |
| 7,380,308 | B2 * | 6/2008 | Oh | A47L 9/1481 15/327.2 |
| 7,395,579 | B2 | 7/2008 | Oh | |

(Continued)

FOREIGN PATENT DOCUMENTS

| | | | |
|---|---|---|---|
| CN | 101108108 | A | 1/2008 |
| CN | 201920657 | U | 8/2011 |

(Continued)

OTHER PUBLICATIONS

Chinese Patent Office Action for Application No. 201980044203.1 dated Mar. 1, 2022 (8 pages including statement of relevance).

(Continued)

*Primary Examiner* — Brian D Keller
*Assistant Examiner* — Tim Brady
(74) *Attorney, Agent, or Firm* — Michael Best & Friedrich LLP

(57) ABSTRACT

A vacuum cleaner includes a first latch moveable between a locked position and an unlocked position and a second latch moveable between a locked position and an unlocked position, and a spring pressing the second latch to the locked position. The vacuum cleaner also includes a dust bin securable on the housing with the first latch and the second latch. When the dust bin is being installed onto the housing, the second latch is moved from the locked position to the unlocked position until the spring presses the second latch back to the locked position. The dust bin is removable from the housing when the dust bin is installed on the housing, the first latch is in the unlocked position, and the second latch is in the locked position.

20 Claims, 5 Drawing Sheets

(56) References Cited

U.S. PATENT DOCUMENTS

| | | | | |
|---|---|---|---|---|
| 7,507,269 | B2 | 3/2009 | Murphy et al. | |
| 7,776,115 | B2 | 8/2010 | Oh et al. | |
| 8,640,301 | B1 * | 2/2014 | Lee | A47L 9/106 15/327.2 |
| 9,009,914 | B2 | 4/2015 | Tran | |
| 9,295,995 | B2 | 3/2016 | Conrad | |
| 9,326,652 | B2 | 5/2016 | Conrad | |
| 9,693,664 | B2 | 7/2017 | Tran | |
| 9,706,889 | B1 | 7/2017 | Lee et al. | |
| 9,775,482 | B2 | 10/2017 | Tran et al. | |
| 10,342,405 | B2 * | 7/2019 | Nam | A47L 11/4066 |
| 10,548,442 | B2 | 2/2020 | Conrad | |
| 11,229,341 | B2 | 1/2022 | Bradley | |
| 2003/0005547 | A1 * | 1/2003 | Bone | A47L 9/1409 15/352 |
| 2004/0134022 | A1 | 7/2004 | Murphy et al. | |
| 2004/0231091 | A1 | 11/2004 | Oh | |
| 2006/0101609 | A1 | 5/2006 | Oh et al. | |
| 2006/0225243 | A1 | 10/2006 | Kim | |
| 2007/0209149 | A1 | 9/2007 | Lee | |
| 2008/0264017 | A1 | 10/2008 | Oh et al. | |
| 2008/0282497 | A1 | 11/2008 | Griffith et al. | |
| 2014/0059799 | A1 * | 3/2014 | Kim | A47L 9/16 15/353 |
| 2014/0237766 | A1 | 8/2014 | Conrad | |
| 2014/0237956 | A1 | 8/2014 | Conrad | |
| 2016/0242610 | A1 | 8/2016 | Tran | |
| 2017/0112341 | A1 | 4/2017 | Han | |
| 2017/0290476 | A1 | 10/2017 | Conrad | |
| 2017/0347851 | A1 | 12/2017 | Tran | |
| 2018/0132687 | A1 | 5/2018 | Reeves et al. | |

FOREIGN PATENT DOCUMENTS

| | | | |
|---|---|---|---|
| CN | 102293612 | A | 12/2011 |
| CN | 206434260 | U | 8/2017 |
| CN | 108065862 | A | 5/2018 |
| CN | 109330482 | A | 2/2019 |
| EP | 1917896 | A1 | 5/2008 |
| GB | 2377165 | A | 1/2003 |

OTHER PUBLICATIONS

Chinese Patent Office Action for Application No. 201980044203.1 dated Jul. 5, 2021 (11 pages including statement of relevance).
International Search Report and Written Opinion for Application No. PCT/US2019/042215 dated Oct. 4, 2019 (13 pages).

* cited by examiner

VACUUM CLEANER

CROSS-REFERENCE TO RELATED APPLICATIONS

This application is a continuation of U.S. patent application Ser. No. 16/514,466, filed Jul. 17, 2019, which issued as U.S. Pat. No. 11,229,341 on Jan. 25, 2022, which claims priority to U.S. Provisional Patent Application No. 62/700,493, filed Jul. 19, 2018, the entire contents of which are hereby incorporated by reference herein.

FIELD OF THE INVENTION

The present invention relates to vacuum cleaners, and more particularly to vacuum cleaners with removable dust bins.

BACKGROUND OF THE INVENTION

Vacuum cleaners have dust bins that are installable onto the vacuum cleaner to capture dust brought into the vacuum cleaner. When an operator so desires, the dust bin is removable from the vacuum cleaner.

SUMMARY OF THE INVENTION

In one embodiment, a vacuum cleaner includes a housing having a dust inlet and a first latch. The first latch is moveable between a locked position and an unlocked position. The vacuum cleaner also includes a second latch moveable between a locked position and an unlocked position, and a spring pressing the second latch to the locked position. The vacuum cleaner also includes a dust bin securable on the housing with the first latch and the second latch. When the dust bin is being installed onto the housing, the second latch is moved from the locked position to the unlocked position until the spring presses the second latch back to the locked position. The dust bin is secured on the housing when the dust bin is installed on the housing, the first latch is in the locked position, and the second latch is in the locked position. The dust bin is removable from the housing when the dust bin is installed on the housing, the first latch is in the unlocked position, and the second latch is in the locked position.

In one embodiment, a vacuum cleaner includes a housing, a dust inlet, a dust bin securable on the housing, a latch moveable between a locked position and an unlocked position, a spring pressing the latch to the locked position, and a guide configured to move the latch from the locked position to the unlocked position. The dust bin is installable onto the housing by the guide moving the latch from the locked position to the unlocked position until the spring presses the latch back to the locked position. The dust bin is removable from the housing by movement of the dust bin along the housing while the latch is in the locked position.

In one embodiment, a vacuum cleaner includes a housing, a dust inlet, a latch on the housing and defining a plane, and a dust bin securable on the housing with the latch. The dust bin is installable onto the housing by movement of the dust bin toward the latch in a direction transverse to the plane. The dust bin is removable from the housing by movement of the dust bin along the latch in a direction parallel to the plane.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
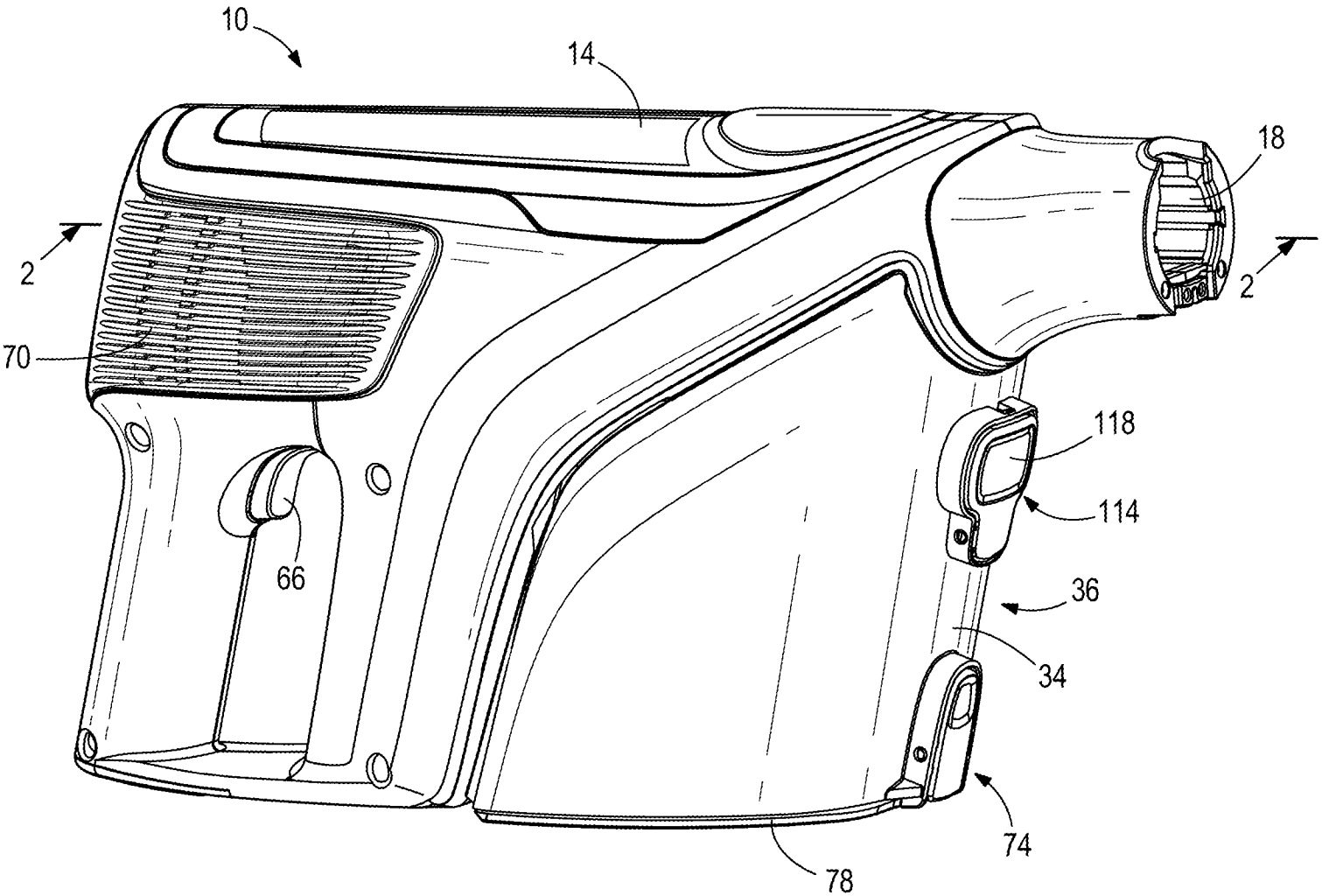
FIG. 1 is a perspective view of a vacuum cleaner.
Figure 2:
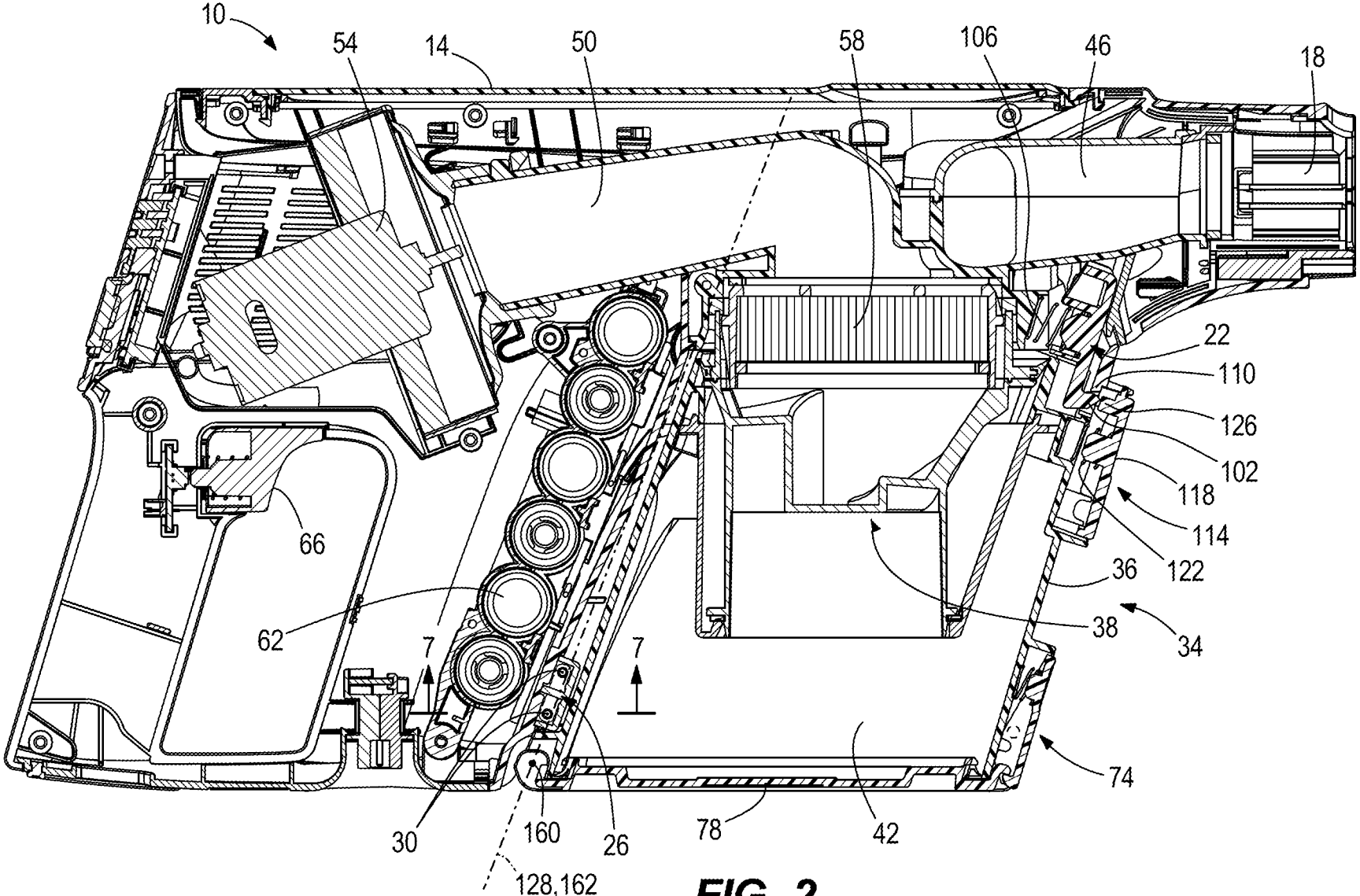
FIG. 2 is a cross-sectional view of the vacuum cleaner of FIG. 1.
Figure 4:
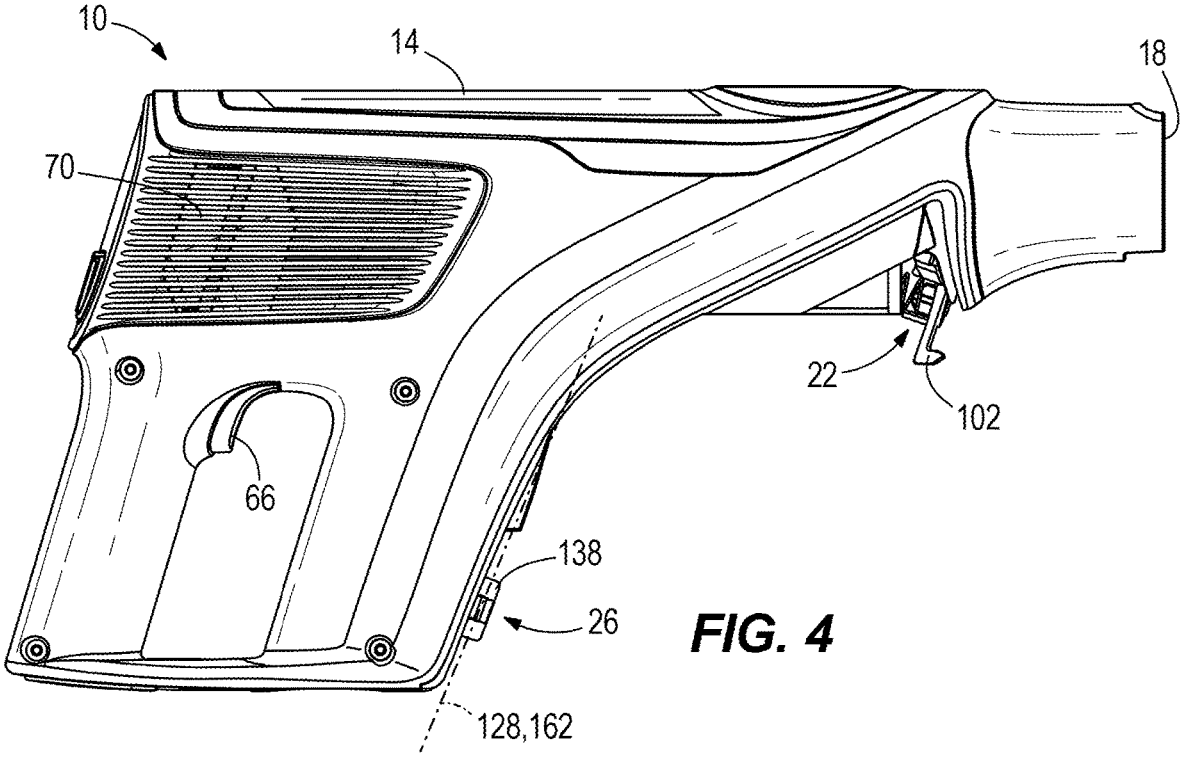
FIG. 4 is a plan view of the vacuum cleaner of FIG. 1 with a dust bin removed.
Figure 5:
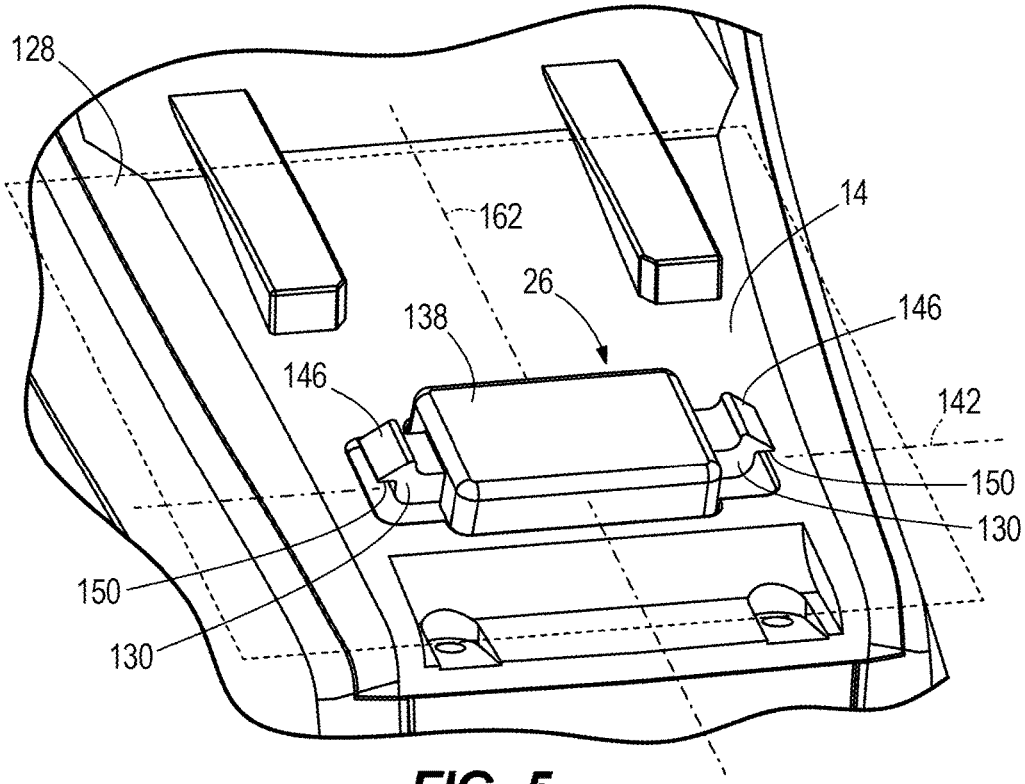
FIG. 5 is an enlarged perspective view of the vacuum cleaner of FIG. 1 with a dust bin removed.

FIGS. 1, 2 and 5 illustrate a vacuum cleaner 10 with a housing 14 having a dust inlet 18. As shown in FIGS. 2 and 4-7, the vacuum cleaner 10 includes a first latch 22 moveable between a locked and an unlocked position, and a second latch 26 moveable between a locked position and an unlocked position. The vacuum cleaner 10 also includes one or more springs 30 pressing the second latch 26 to the locked position. The vacuum cleaner 10 further includes a dust bin 34 securable on the housing 14 with the first latch 22 and the second latch 26. When the dust bin 34 is being installed on the housing 14, the second latch 26 is moved from the locked position to the unlocked position until the spring 30 presses the second latch 26 back to the locked position. The dust bin 34 is secured on the housing 14 when the dust bin 34 is installed on the housing, the first latch 22 is in the locked position, and the second latch 26 is in the locked position. The dust bin 34 is removable from the housing 14 when the dust bin 34 is installed on the housing 14, the first latch 22 is in the unlocked position, and the second latch 26 is in the locked position.

In the embodiment illustrated in FIG. 2, dust bin 34 includes a housing 36, a separator assembly 38 and a debris collection chamber 42. The vacuum cleaner 10 includes an inlet conduit 46 fluidly coupling the dust inlet 18 to the separator assembly 38 and an outlet conduit 50 fluidly coupling the separator assembly 38 to a suction source, such as a suction motor 54, to generate an airflow through the dust inlet 18 to draw debris with the airflow through the dust inlet 18. In the illustrated embodiment, a filter 58 is arranged fluidly between the separator assembly 38 and the outlet conduit 50. The vacuum cleaner 10 includes a power source, such as one or more rechargeable batteries 62, to provide power to the suction motor 54, and a switch 66 to actuate the suction motor 54. In other embodiments, the vacuum cleaner 10 includes a removably rechargeable battery pack. The vacuum cleaner 10 also includes a plurality of exhaust vents 70 on the housing 14 to exhaust the airflow from the suction motor 54 and out of the housing 14. With reference to FIG. 2, the dust bin 34 includes a door actuator 74 to open a door 78 of the dust bin 34.

Figure 3:
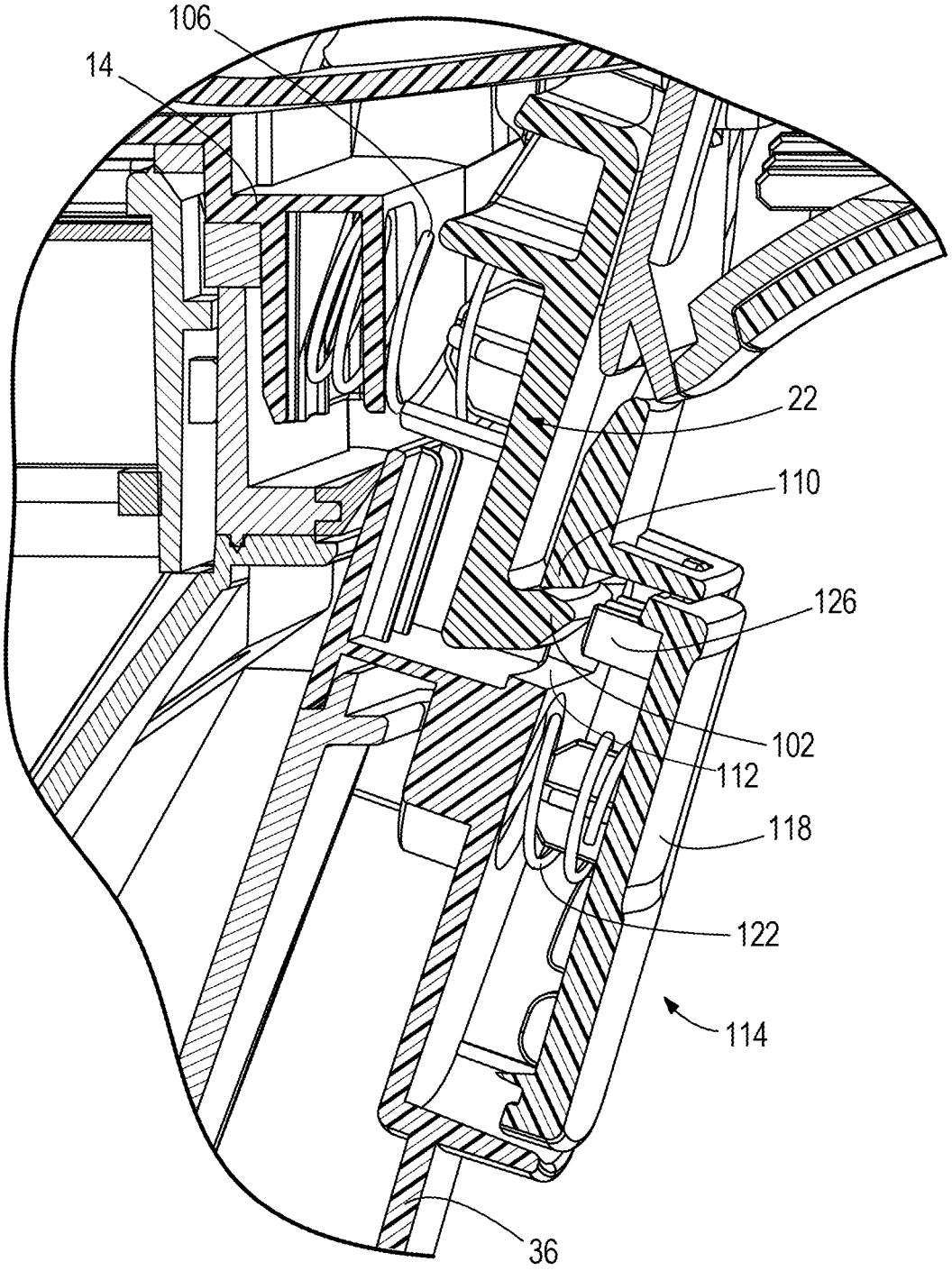
FIG. 3 is a cross-sectional view of the vacuum cleaner of FIG. 1.

With reference to the embodiment illustrated in FIGS. 2 and 3, the first latch 22 is arranged on the housing 14 of the vacuum cleaner 10. The first latch 22 includes a catch 102 that is pressed by a first latch spring 106 away from the housing 14 of the vacuum cleaner 10 to a locked position of the first latch 22. When the dust bin 34 is installed on the housing 14 of the vacuum cleaner 10 and the first latch 22 is in the locked position, the catch 102 engages an edge 110 of the dust bin 34 formed by an aperture 112 through the dust bin 34 as shown in FIG. 4 or a flange or other cooperative engaging feature. In the illustrated embodiment, the dust bin 34 includes a first latch actuator 114. The first latch actuator 114 includes a first latch button 118 that is pressed by a first latch button spring 122 away from the housing 36 of the dust bin 34. The first latch button 118 includes an actuating edge 126 positioned to engage and unlock the first latch 22 when the dust bin 34 is installed on the housing 14 and the first latch actuator 114 is actuated. As described in further detail below, when the dust bin 34 is installed on the vacuum cleaner 10 and the first latch 22 is in the locked position, the catch 102 engages the edge 110 to prevent the dust bin 34 from being removed from the housing 14 of the vacuum cleaner 10.

Figure 6:
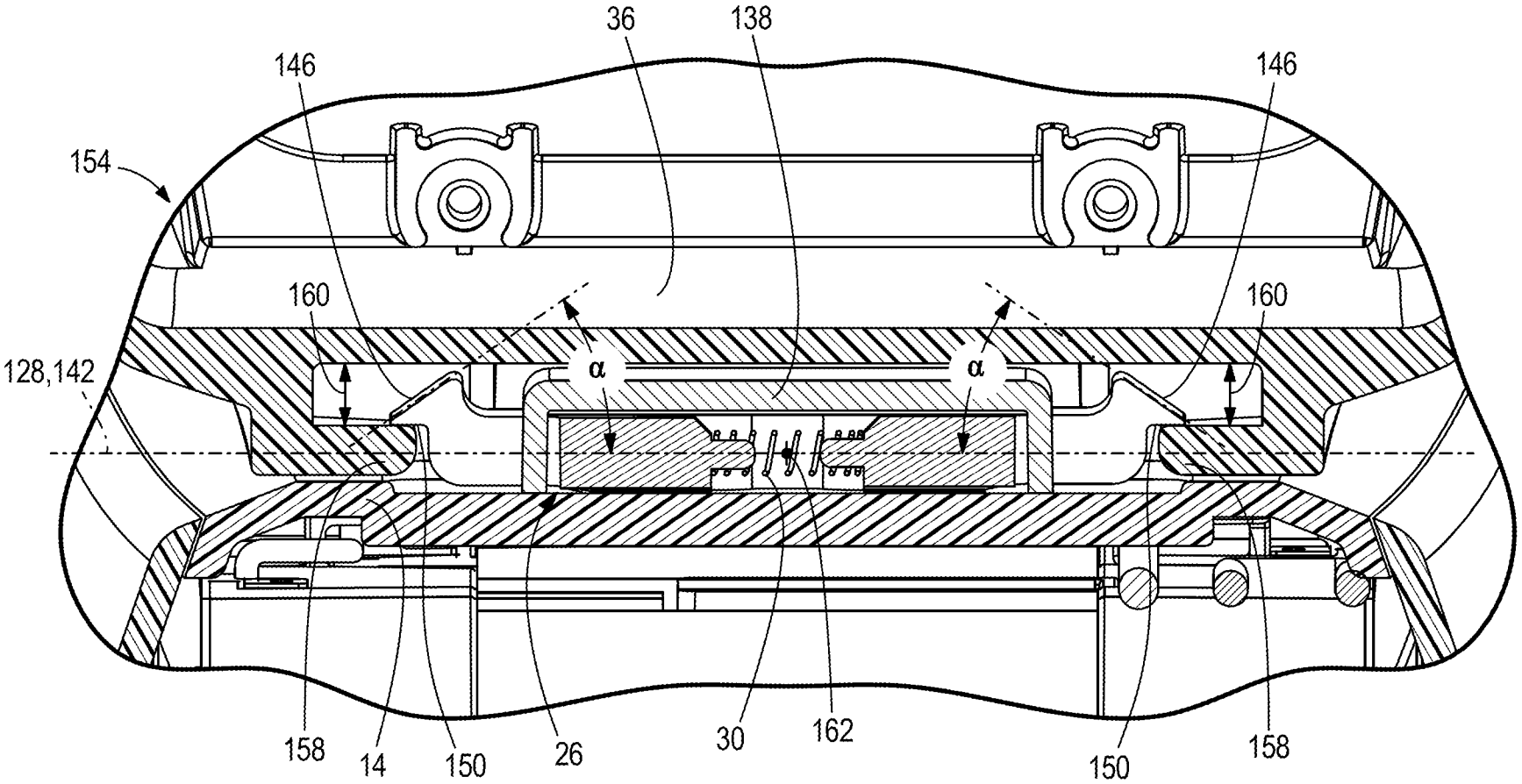
FIG. 6 is a cross-sectional view of the vacuum cleaner of FIG. 1.

With references to FIGS. 4-6, the illustrated second latch 26 defines a plane 128 and includes a pair of arms 130 that are pressed away from each other along the plane 128 by the one or more springs 30, which are arranged in a second latch housing 138 on the housing 14 of the vacuum cleaner 10. The arms 130 are moveable towards and away from each other in a direction of engagement along a first axis 142 that is arranged on the plane 128. The second latch 26 is thus moveable between a locked position, in which the arms 130 are pressed away from each other by the one or more springs 30, and an unlocked position, in which the arms 130 are moved toward each other along the first axis 142. The spring 30 may be any resilient member, such as a coil spring, leaf spring, elastomeric part, or other spring or resilient material or component. In other embodiments, the spring 30 is not a separate component but is the resilient property of the material or the geometry of the second latch 26. For example, the arms 130 may themselves be formed of a resilient material.

With reference to FIGS. 5 and 6, each arm 130 includes a hook or restraint formed by first face 146 and a second face 150 that is opposite the first face 146. In the embodiment illustrated in FIGS. 5 and 6, each of the first faces 146 are arranged at an acute angle $\alpha$ with respect to the plane 128 and thus functional as a guiding face. Each of the second faces 150 are parallel to the plane 128 and thus functional as a locking face. In one embodiment, the second faces 150 are coincident with the plane 128. With reference to FIG. 6, the dust bin 34 includes an engagement portion or guide 154 configured to cooperatively interlock with the second latch 26. In the illustrated embodiment, the engagement portion or guide 154 includes a pair of legs 158 extending toward each other in a direction parallel to the housing 36 of the dust bin 34. A gap 160 is defined between each leg 158 and the housing 36 of the dust bin 34. As shown in FIG. 6, when the dust bin 34 is installed on the housing 14 of the vacuum cleaner 10, the legs 158 of the guide 154 are arranged between the second latch 26 and the housing 14 of the vacuum cleaner. Specifically, the legs 158 of the guide 154 are arranged between the arms 130 and the housing 14 of the vacuum cleaner 14 such that the locking faces 150 retain the legs 158 to the housing. Although the illustrated embodiment shows the second latch 26 as being on the housing 14 of the vacuum cleaner 10 and the guide 154 being on dust bin 34, in other embodiments, the second latch 26 is on the dust bin 34 and the guide 154 is on the housing 14 of the vacuum cleaner 10.

In operation, to install the dust bin 34 on the housing 14 of the vacuum cleaner 10, the operator engages the first latch 22 with the dust bin 34 by arranging the edge 110 of the dust bin 34 over the catch 102 of the first latch 22. The operator then moves the dust bin 34 towards the second latch 26 in a direction transverse to the plane 128 until the guide 154 contacts the second latch 26. In some embodiments, the operator pivots the dust bin 34 about the catch 102 in a direction towards the second latch 26. The guide 154 then moves the second latch 26 from the locked position to the unlocked position, until the second latch 26 is pressed by the one or more springs 30 back to the locked position. Specifically, the legs 158 of the of the guide 154 press against the first faces 146 of the arms 130 while moving towards the housing 14 of the vacuum cleaner 10. Because each of the first faces 146 are arranged at an acute angle $\alpha$ with respect to the plane, the legs 158 slide along the first faces 146 pushing the arms 130 toward each other along the first axis 142 as the legs 158 move past the arms 130.

Once the legs 158 move past the arms 130, the second latch 26 is pressed by the one or more springs 30 back to the locked position. Specifically, the arms 130 are pushed away from each other by the one or more springs 30 such that the second faces 150 extend over a portion of the legs 158. The dust bin 34 is then secured on the housing 14 of the vacuum cleaner 10 with the first latch 22 and the second latch 26. Once secured, the legs 158 of the guide 154 are arranged between the second latch 26 and the housing 14 of the vacuum cleaner 10. Specifically, the legs 158 are arranged between the second faces 150 of the arms 130. When the dust bin 34 is installed on the housing 14 and the second latch 26 is in the locked position, the second latch 26 prevents the dust bin 34 from moving in a direction transverse to the plane 128. Specifically, the second faces 150 of the arms 130 trap the guide 154 and prevent it from moving in a direction transverse to the plane 128. Also, while the first latch 22 is in the locked position, the dust bin 34 is prevented from moving in a direction parallel to the plane 128 away from the housing 14 because the catch 102 of the first latch 22 engages the edge 110 of the dust bin 34.

In the embodiment illustrated by FIGS. 4-6, the second latch 26 includes two spring-actuated arms 130 that are pressed away from each other to engage corresponding features on the dust bin 34, and are positioned such that the dust bin 34 can slide out from under the second latch 26 when the first latch 22 is unlocked. In other embodiments, more than two spring-actuated arms 130 may be arranged to engage corresponding features on the dust bin 34 and positioned such that the dust bin 34 can slide out from under the second latch 26 when the first latch is unlocked 22. Similarly, in an alternative embodiment, one arm 130 may be used.

In other embodiments, the arms 130 move toward one another to the locked position. In yet another alternative, instead of linear movement, the arms 130 rotate along the plane 128 between locked and unlocked positions. In another alternative, the arms 130 may extend as a cantilever transverse to plane 128 and flex between locked and unlocked positions.

Once the dust bin 34 is secured on the housing 14, an operator may activate the switch 66 to actuate the suction motor 54. Airflow containing dust is drawn in through the dust inlet 18, through the inlet conduit 46 and into the separator assembly 38. Once in the separator assembly 38, cyclonic action causes larger dust particles to drop into the debris collection chamber 42 of the dust bin 34. The airflow then continues on through the filter 58 where additional particular matter is separated from the airflow. The airflow then continues through the outlet conduit 50 to the suction motor 54, and is then exhausted out the exhaust vents 70 on the housing 14. Once the cleaning operation is finished, the door actuator 74 can be actuated, thereby allowing the door 78 of the dust bin 34 to pivot open. The debris collection chamber 42 can be emptied while the dust bin 34 is installed on the housing 14, or the dust bin 34 may be removed from the housing 14 to be cleaned.

In order to remove the dust bin 34 from the housing 14 of the vacuum cleaner 10, the operator presses the first latch button 118 towards the housing 36 of the dust bin 34, causing the actuating edge 126 to push the catch 102 out of engagement with the edge 110 of the dust bin 34, thereby switching the first latch 22 to an unlocked position. After the first latch 22 is moved to the unlocked position, the second latch 26 in the locked position still prevents the dust bin 34 from moving in a direction transverse to the plane 128. However, once the first latch 22 is in an unlocked position, the dust bin 34 may be removed from the housing 14 while the second latch 26 is still in the locked position. Specifically, the dust bin 34 is moveable along the housing in a direction parallel to the plane 128, causing the legs 158 of the guide 154 to move between the second latch 26 and the housing 14 of the vacuum cleaner 10 until the legs 158 move past the second faces 150 and free of the second latch 26 such that the dust bin 34 is removed from the vacuum cleaner. As the dust bin 34 moves in a direction parallel to the plane 128, the dust bin 34 moves along the housing 14 until it is removed from engagement by the second latch 26. The dust bin 34 is removed from the housing 14 along a second axis 162 that is defined on the plane 128 and is perpendicular to the first axis 142.

In the embodiment illustrated by FIGS. 4-6, the dust bin 34 is movable linearly along the housing 14 perpendicular to the direction of engagement to remove the dust bin 34 from engagement by the second latch 26 when the first latch 22 is unlocked. In another alternative, the dust bin 34 is configured to rotate along the housing 14 in the plane 128 to move the dust bin 34 out from under the second latch 26 when the first latch 22 is unlocked.

Although the invention has been described in detail with reference to certain preferred embodiments, variations and modifications exist within the scope and spirit of one or more independent aspects of the invention as described.

What is claimed is:

1. A surface cleaner comprising:

a housing;

a dust bin releasably connected to the housing by a latch engageable with a guide;

the guide including a pair of legs defining a plane along the housing, the legs extending in a bin-removal direction, each leg forming a gap;

the latch including a pair of latching arms, each latching arm movable along the plane between a locked position and an unlocked position, each latching arm having a locking surface and a guiding surface, the guiding surface disposed at an acute angle to the plane such that a force applied to the guiding surface in a direction transverse to the plane moves the latching arm along the plane, a spring pressing each latching arm toward the locked position;

wherein engagement of the latch to the guide in a direction transverse to the guide presses each guiding surface moving the latching arms from the locked position to the unlocked position along the plane;

wherein further movement of the latch to the guide in a direction transverse to the guide moves each latching arm into the gap formed by the leg allowing the spring to move the latching arm to the locked position engaging each locking surface against the legs;

wherein movement of the latch in the locked position along the plane in the bin-removal direction until the locking surfaces move past the legs to release the latch from the guide.

2. The surface cleaner of claim 1, wherein the legs extend in a longitudinal direction along the housing.

3. The surface cleaner of claim 1, wherein the latch is attached to the dust bin and the guide is connected to the housing.

4. The surface cleaner of claim 1, wherein the latching arms are disposed between the legs when the dust bin is connected to the housing.

5. The surface cleaner of claim 1, wherein the latching arms move along the plane in a direction perpendicular to the legs.

6. The surface cleaner of claim 1, wherein the latching arms move collinearly along the plane in a direction transverse to the legs.

7. The surface cleaner of claim 1, wherein the latch is a first latch, the surface cleaner further including a second latch inhibiting movement of the dust bin in a longitudinal direction, the second latch moveable between a locked position and an unlocked position, wherein the dust bin is removable from the housing when the first latch is in the locked position and the second latch is in the unlocked position.

8. The surface cleaner of claim 7, wherein the second latch is on the dust bin.

9. The surface cleaner of claim 7, wherein the second latch is on the housing.

10. The surface cleaner of claim 7, wherein the second latch includes a catch that is pressed by a latch spring away from the housing to the locked position of the second latch.

11. The surface cleaner of claim 10, wherein when the dust bin is installed on the housing \and the second latch is in the locked position, the catch engages an edge of the dust bin formed by an aperture through the dust bin.

12. The surface cleaner of claim 7, wherein the dust bin includes an actuator for the second latch to move the second latch from the locked position to the unlocked position.

13. The surface cleaner of claim 12, wherein the actuator includes a latch button that is pressed by a latch button spring away from the housing of the dust bin.

14. The surface cleaner of claim 13, wherein the latch button includes an actuating edge positioned to engage and unlock the second latch when the dust bin is installed on the housing.

15. The surface cleaner of claim 1, wherein the housing includes a dust inlet in fluid communication with the dust bin when the dust bin is connected to the housing.

16. The surface cleaner of claim 15, wherein the surface cleaner includes a battery, wherein the dust bin is located between the battery and the dust inlet.

17. The surface cleaner of claim 1, wherein the dust bin includes a door that is openable to empty the dust bin, wherein the dust bin includes a door actuator operable to open the door.

18. The surface cleaner of claim 1, wherein the dust bin is removable from the housing by movement of the dust bin along the housing while the latch is in the locked position.

19. The surface cleaner of claim 1, wherein when the dust bin is installed on the housing, the guide is arranged between the latch and the housing, and wherein when the dust bin is removable from the housing by movement of the guide between the latch and the housing.

20. The surface cleaner of claim 1, wherein when the dust bin is installed on the housing and the latch is in the locked position, the latch prevents the dust bin from moving in a direction transverse to the plane.

* * * * *